US005119084A

United States Patent [19]

Kawamura et al.

[11] Patent Number: 5,119,084

[45] Date of Patent: Jun. 2, 1992

[54] LIQUID CRYSTAL DISPLAY APPARATUS

[75] Inventors: Masao Kawamura; Takahiro Fuse, both of Tokyo, Japan

[73] Assignee: Casio Computer Co., Ltd., Tokyo, Japan

[21] Appl. No.: 440,496

[22] Filed: Nov. 22, 1989

[30] Foreign Application Priority Data

| | | | |
|---|---|---|---|
| Dec. 6, 1988 | [JP] | Japan | 63-306946 |
| Dec. 6, 1988 | [JP] | Japan | 63-306947 |
| Dec. 6, 1988 | [JP] | Japan | 63-306948 |
| Dec. 6, 1988 | [JP] | Japan | 63-306949 |
| Jul. 20, 1989 | [JP] | Japan | 1-188312 |

[51] Int. Cl.[5] ..... G09G 3/36

[52] U.S. Cl. ..... 340/784; 358/236

[58] Field of Search ..... 340/784, 765, 793, 728, 340/744; 350/333, 332 R; 358/105, 167, 236, 241

[56] References Cited

U.S. PATENT DOCUMENTS

| | | | |
|---|---|---|---|
| 4,296,436 | 10/1981 | Achina | 358/105 |
| 4,679,086 | 7/1987 | May | 358/105 |
| 4,860,105 | 8/1989 | Sakaguchi et al. | 358/167 |

*Primary Examiner*—Ulysses Weldon
*Assistant Examiner*—Xiho Min Wu
*Attorney, Agent, or Firm*—Frishauf, Holtz, Goodman & Woodward

[57] ABSTRACT

In a liquid crystal driving apparatus for driving a liquid crystal display panel in accordance with an image signal, the response speed of a liquid crystal display panel is increased so as not to produce an afterimage upon motion image display. A signal is preprocessed by an inverse transfer function of the transfer function of the liquid crystal panel, i.e., signal processing for emphasizing an image change in a timer direction is performed, and the liquid crystal display panel is driven by using the processed data.

15 Claims, 10 Drawing Sheets $$Xn = \frac{1}{3}[2Wn - Wn-1] + \frac{1}{3}$$

LIQUID CRYSTAL DISPLAY APPARATUS

BACKGROUND OF THE INVENTION

1. Field of the Invention

The present invention relates to a liquid crystal driving apparatus for driving a dot-matrix type liquid crystal display panel.

2. Description of the Related Art

Conventionally, a dot-matrix type liquid crystal display panel is generally used as a display unit of, e.g., a portable compact TV receiver or a compact electronic calculator. FIG. 1 shows the arrangement of a driving circuit of such a liquid crystal display panel. Referring thereto, reference numeral 11 denotes an N×M-dot dot-matrix type liquid crystal display panel (LCD); numeral 12, a segment driver for driving a segment electrode of the display panel 11; 13, a common driver for driving a common electrode of the display panel 11; 14, an A/D converter for quantizing an analog video input signal in units of pixels of N×M dots; and 15, a timing signal generator for sending timing signals to the segment driver 12, the common driver 13, and the A/D converter 14.

The A/D converter 14 quantizes an analog video signal in units of pixels of N×M dots in synchronism with the timing signal from the generator 15 and sends the quantized signal to the segment driver 12. The driver 12 forms a gradation signal on the basis of the digital data from the A/D converter 14 and drives the segment electrode of the display panel 11. As a result, in the display panel 11, a common electrode selected by the common driver 13 and a segment electrode portion corresponding to the common electrode are driven at a gradation level according to the video signal.

In the liquid crystal driving apparatus having the above arrangement, one frame of a TV image is displayed every 17[ms] (=1/60 [s]). Therefore, the response speed of the liquid crystal display panel is naturally required to be much higher than 17 [ms].

Response speeds of currently available liquid crystal display panels, however, are about 50 to 100 [ms], i.e., longer than the display period of one frame of a TV image. Therefore, an afterimage undesirably appears upon moving image displays in which the image changes rapidly.

SUMMARY OF THE INVENTION

The present invention has been made in consideration of the above situation and has as its object to provide a liquid crystal driving apparatus which does not produce an afterimage.

In order to achieve the above object, the present invention is characterized in that, for image data constituting one image in units of frames, a K (K is a constant) multiple of image data of the (n−1)th frame is subtracted from image data of the nth frame (n is a positive integer), and this subtraction result is multiplied by (1/(1−K)) to drive a liquid crystal display panel.

In the liquid crystal driving apparatus according to the present invention having the above arrangement, a liquid crystal display panel is driven by data subjected to signal processing for emphasizing an image change in a time direction, and an influence component which produces an afterimage is removed, thereby obtaining a display image without an afterimage.

DETAILED DESCRIPTION OF THE PREFERRED EMBODIMENTS

Figure 1:
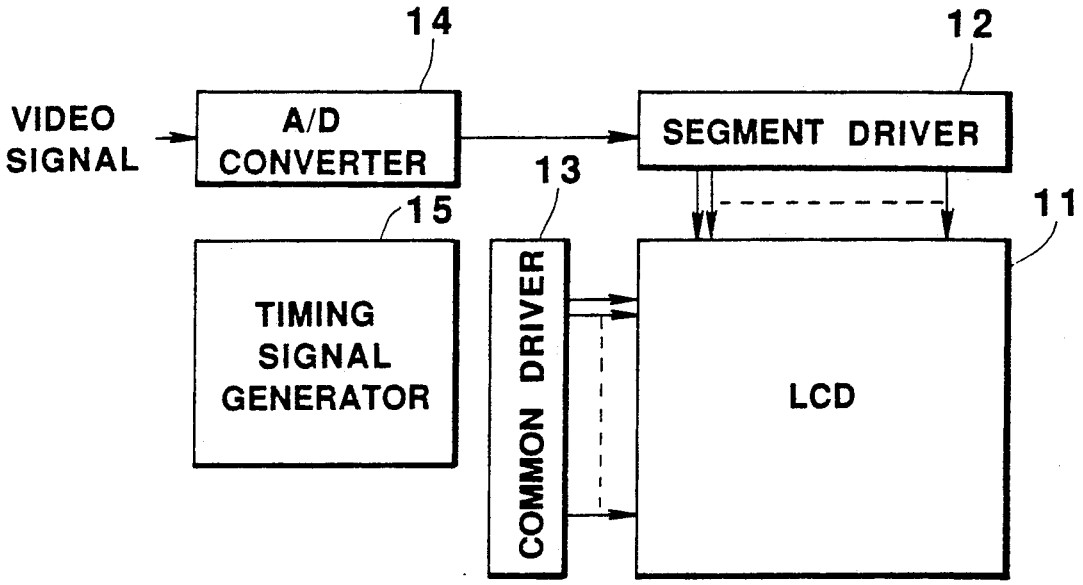
FIG. 1 (PRIOR ART)
FIG. 1 is a block diagram showing a general circuit arrangement of a conventional liquid crystal driving apparatus.

The operation principle of a liquid crystal driving apparatus according to the present invention will be described first.

A pixel in a liquid crystal display panel is set in a selection state in one frame, and image data is refreshed. In this specification, the term "frame" represents a period in which all of the pixels constituting one image of a liquid crystal display panel are scanned once. For example, when all of the pixels constituting one image are scanned once in units of fields of a television signal to produce one display, one frame in this specification is equal to one field of the television signal and does not always coincide with one frame of the television signal.

It is known that a liquid crystal display panel has a cumulative response characteristic. This cumulative response characteristic is represented by the following equation:

$$yn=(1-K)xn+Ky_{n-1} \quad (1)$$

(where

K: constant $x_n$: input image data $y_n$: output image data (data to be displayed))

When equation (1) is subjected to Z transformation, the following equation is obtained:

$$Y(Z) = (1 - K)X(Z) + KZ^{-1}Y(Z) \quad (2)$$

-continued $$Y(Z) = (1 - K)X(Z)/(1 - KZ^{-1})$$

(where $Z^{-1}$: delay operator of one frame)

Therefore, a transfer function H(Z) of the liquid crystal display panel can be assumed as follows:

$$H(Z)=(1-K)W(Z)/(1-K^{-1}) \quad (3)$$

If signal preprocessing is performed by an inverse function of the transfer function of the liquid crystal panel, i.e., if processing represented by the following equation is performed, the display response speed can be increased:

$$X(Z)=(1-KZ^{-1})W(Z)/(1-K) \quad (4)$$

When equation (4) is subjected to inverse Z transformation, the following equation is obtained:

$$xn=(w_n-Kw_{n-1})/(1-K) \quad (5)$$

Note that since the amplitude of the signal $x_n$ obtained as described above is increased, the signal $x_n$ cannot be directly displayed on the liquid crystal display panel. Therefore, the amplitudes of the signals xn and wn must be equalized by a limiter.

By using the signal $x_n$ obtained by the processing represented by equation (5) to drive the liquid crystal display panel, the response speed of the display panel can be improved.

Embodiments of a liquid crystal driving apparatus based on the above operation principle will be described below.

1st Embodiment

The first embodiment of the present invention will be described below with reference to FIG. 2 and FIGS. 3A to 3D.

Figure 2:
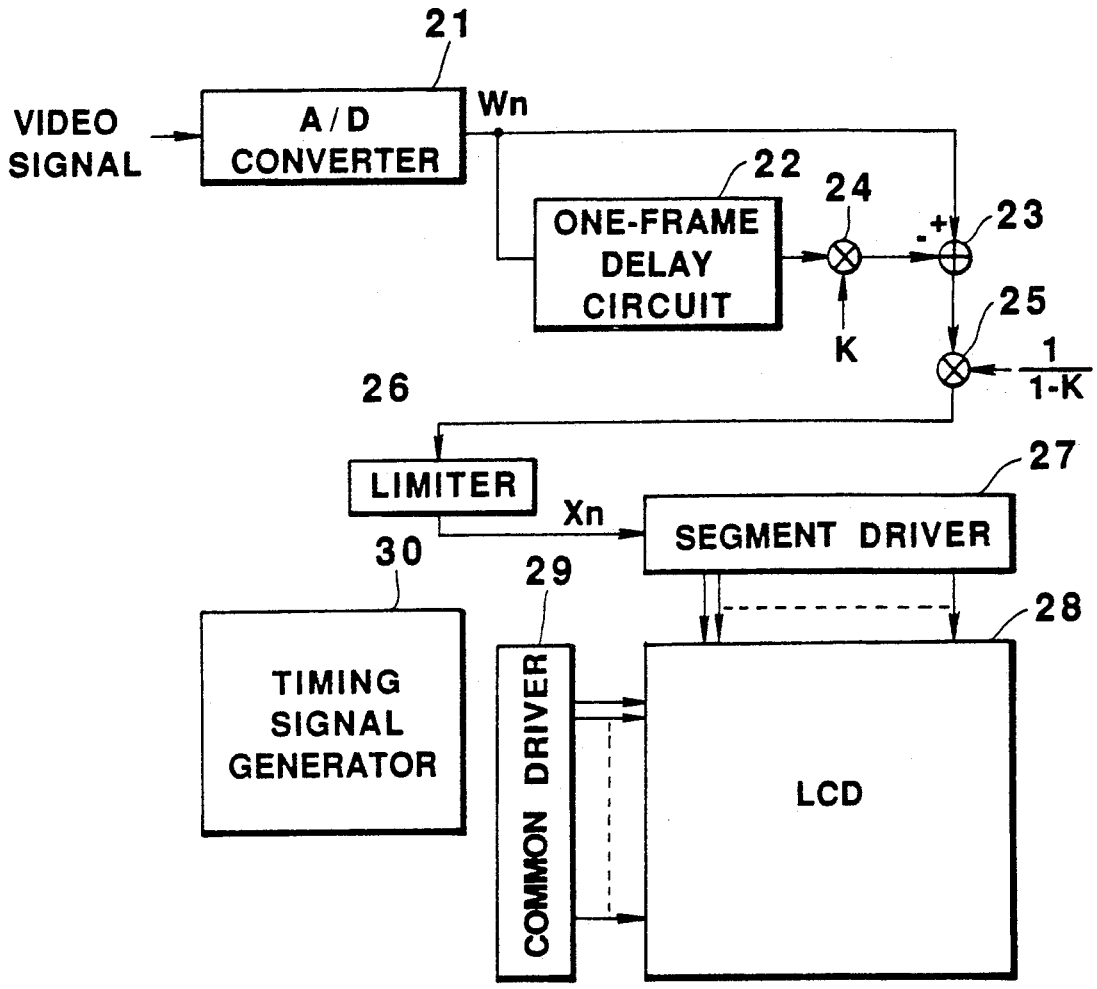
FIG. 2 is a block diagram showing a circuit arrangement of a liquid crystal driving apparatus according to the first embodiment of the present invention.

FIG. 2 shows a circuit arrangement for realizing equation (5). An analog input signal is quantized in units of pixels by an A/D converter 21, and supplied as a digital signal wn to a one-frame delay circuit 22 and the (+) input terminal of a subtracter 23. The delay circuit 22 delays the input signal wn by one frame (=17 [ms]) and outputs the signal as signal $w_{n-1}$ to a multiplier 24. The multiplier 24 multiplies the signal $W_{n-1}$ by K (K is a Constant) to obtain a signal $Kw_{n-1}$ and supplies the signal to the (−) input terminal of the subtracter 23. The subtracter 23 performs a subtraction of:

$$w_n-Kw_{n-1}$$

on the basis of the signal $w_n$ from the converter 21 and the signal $Kw_{n-1}$ from the subtracter 23, and outputs the difference to a multiplier 25. The multiplier 25 multiplies the input signal by $1/(1-K)$ and supplies the signal to a limiter 26. If the supplied signal exceeds the amplitude of the output signal $w_n$ from A/D converter 21, the limiter 26 limits the amplitude of the input signal by an arithmetic operation. The output from the limiter 26 is supplied as a signal xn to a segment driver 27, which drives a segment electrode of a liquid crystal display panel 28 in accordance with the signal $x_n$. A common electrode of the display panel 28 is driven by a common driver 29. The display panel 28, the common driver 29, and the A/D converter 21 operate in synchronism with timing signals supplied from a timing signal generator 30.

In the above arrangement, assume that the response speed in units of pixels of the liquid crystal display panel 28 is, e.g., 50 [ms] ($\approx$3 frames). In this case, the constant K of equation (5) is obtained as "$K=\frac{1}{2}$". Therefore, the multiplier 24 converts the signal $w_{n-1}$ delayed by the delay circuit 22 into a signal "$w_{n-1}/2$", and the subtracter 23 performs a subtraction r of:

$$w_n-w_{n-1}/2$$

The multiplier 25 doubles the input signal and supplies a signal "$2w_n-w_{n-1}$" to the limiter 26. The limiter 26 performs an operation of, e.g.,:

$$x_n=(2w_n-w_{n-1})/3+\tfrac{1}{3}$$

for the supplied signal and outputs an obtained signal $x_n$ to the driver 27.

Figure 3A:
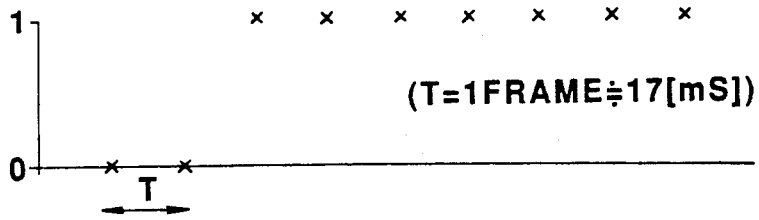
FIGS. 3A to 3D are graphs showing the relationship between image data and display data in the liquid crystal driving apparatus shown in FIG. 2.
Figure 3B:
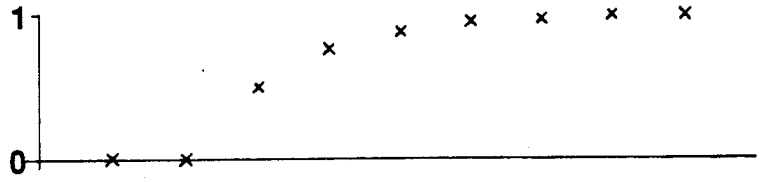
Figure 3C:
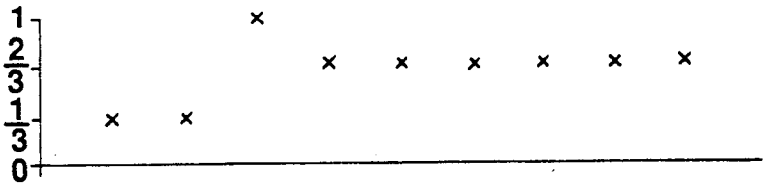
Figure 3D:
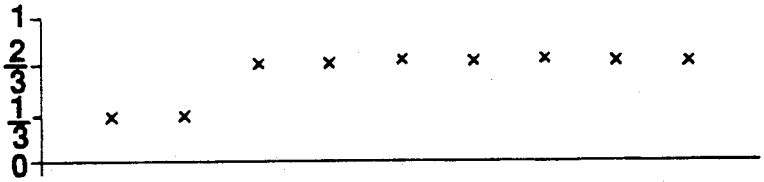

Assume that a digital signal $w_n$ as shown in FIG. 3A is output from the A/D converter 21 as a video signal corresponding to a certain pixel on the liquid crystal display panel 28. Referring to FIG. 3A, the abscissa data within the range of "0" to "1". When the output signal $w_n$ from the A/D converter 21 is supplied directly to the segment driver 27 without performing any processing, data $y_n$ displayed on the display panel 28 includes afterimages caused by a cumulative response characteristic of the display panel 28 a shown in FIG. 3B. On the contrary, a signal $x_n$ output from the limiter 26 becomes a signal in which an image change is emphasized as shown in FIG. 3C. When the segment driver 27 drives the segment electrode of the display panel 28 in accordance with this signal $x_n$, while the contrast of display data on the display panel 28 is reduced to be $\frac{1}{3}$ that of the signal $x_n$ shown in FIG. 3A, its response characteristic is satisfactorily improved as to cause no afterimage, as shown in FIG. 3D.

Note that as the operation is performed by the limiter 26 in the above embodiment, a method of limiting data to "0" if the data is "0" or less and limiting data to "1" if the data is "1" or more may be performed. In L this case, when data changes from "0" to "1" as shown in FIG. 3A, the same response characteristic as in the conventional apparatus is obtained since no preprocessing is performed by the one-frame delay circuit 22, the subtracter 23, and the multipliers 24 and 25. When data changes from "$\frac{1}{3}$" to "$\frac{2}{3}$", however, the response characteristic is satisfactorily improved while the contrast is not reduced.

In addition, various operations can be performed in correspondence with a relationship between an improvement degree of a response speed and an allowable value of contrast. That is, the operation may be selected in accordance with its application.

According to the first embodiment described above in detail, data subjected to signal processing, for emphasizing an image change in a period of time, is used to drive the liquid crystal display panel. Therefore, the influence which produces an afterimage can be removed, and the low response speed of the liquid crystal display panel can be compensated for.

2nd Embodiment

The second embodiment of the present invention will be described below.

In the second embodiment, a still image region in which an image moves less and a motion image region in which an image moves more are discriminated from each other, and only the motion image region is subjected to signal processing for emphasizing an image change in a time direction, thereby increasing the response speed of only the necessary image region, without producing an afterimage or noise.

A liquid crystal driving apparatus according to the second embodiment will be described with reference to FIG. 4.

Figure 4:
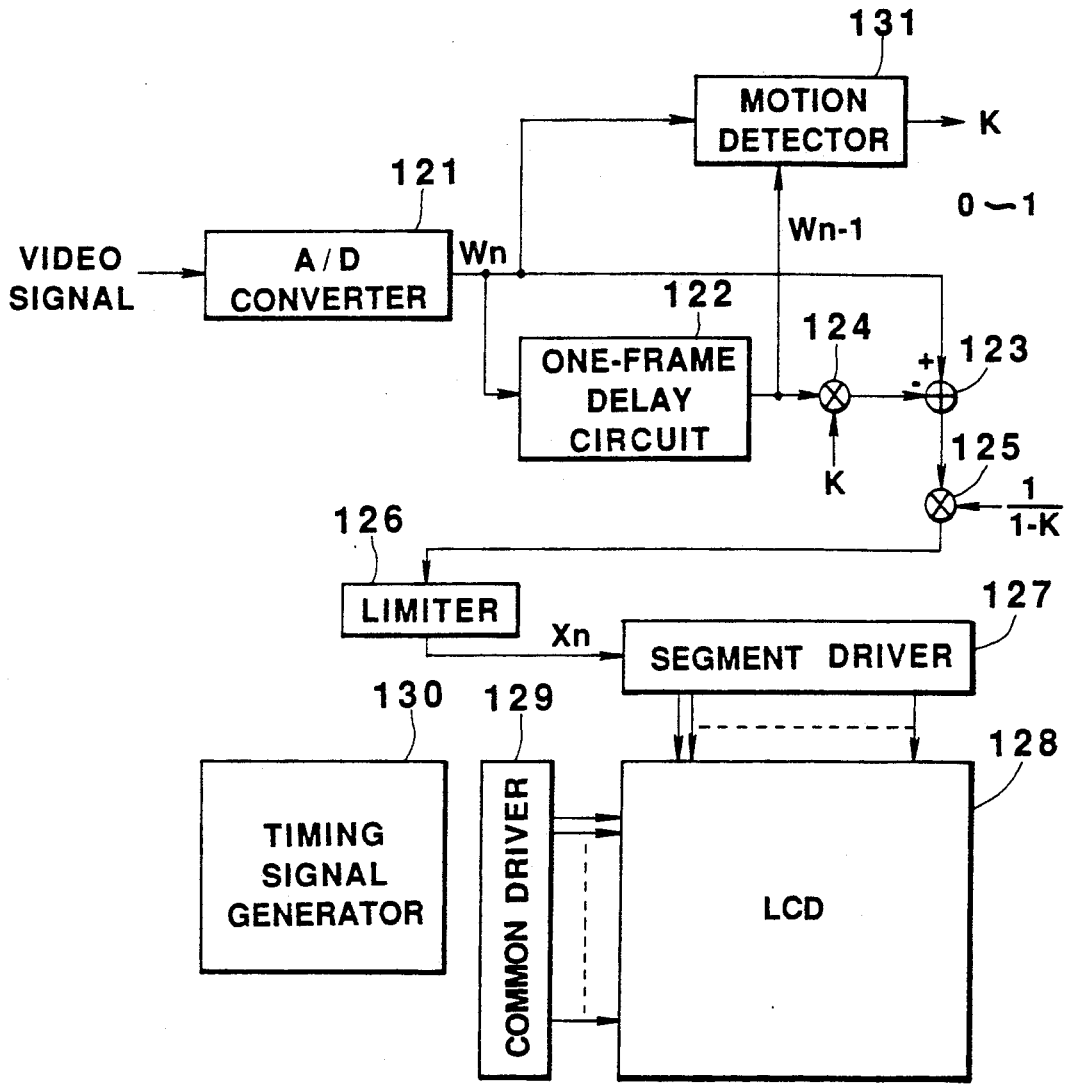
FIG. 4 is a block diagram showing a circuit arrangement of a liquid crystal driving apparatus according to the second embodiment of the present invention.

As shown in FIG. 4, an analog video input signal is quantized in units of pixels of N×M dots by an A/D converter 121 and supplied as a digital signal $w_n$ to a one-frame delay circuit 122 and the (+) input terminal of a subtracter 123. The delay circuit 122 delays the input signal $w_n$ by one frame (=17 [ms]) and outputs the signal as a signal $w_{n-1}$ to a multiplier 124. The multiplier 124 multiplies the signal $w_{n-1}$ by K and supplies the signal to the (−) input terminal of the subtracter 123. The subtracter 123 performs a subtraction of:

$$w_n - Kw_{n-1}$$

on the basis Of the signal wn from the A/D converter 121 and the signal $w_{n-1}$ from the subtracter 123, and The multiplier 125 multiplies the input signal by 1/(1−K) and supplies the signal to a limiter 126. If the supplied signal exceeds the amplitude of the output signal wn from the A/D converter 121, the limiter 126 limits the signal by an arithmetic operation. An output from the limiter 126 is sent as a signal $x_n$ to a segment driver 127, which drives a segment electrode of a liquid crystal display panel (LCD) 128 in accordance with the signal $x_n$. A common electrode of the display panel 128 is driven by a common driver 129, and both of these, together with the A/D converter 121, operate in synchronism with timing signals supplied from a timing signal generator 130.

The digital signal $w_n$ output from the A/D converter 121 and the signal $w_{n-1}$ output from the one-frame delay circuit 122 are also supplied to a motion detector 31. The detector 131 checks, on the basis of the difference between the signals $w_n$ and $w_{n-1}$ having a time difference corresponding to one frame, whether the image change (motion) of a pixel is large, and outputs a constant K to the multipliers 124 and 125 in accordance with the check result.

Each of the digital signals $w_n$, output from the A/D converter 121, and $w_{n-1}$, delayed by one frame by the delay circuit 122, is a brightness component of a video signal represented by data having a weight of m bits. Therefore, whether an image change is large can be checked by determining whether the difference between the signals is larger than a predetermined number of bits. The value of the constant K output from the detector 131 in accordance with the determination result falls within the range of "$0 \leqq K < 1$". If the change is determined to be small, the value of the constant K is set to be "0". As a result, the output from the multiplier 124 becomes "0", and the multiplier 125 becomes a through path, thereby forming a circuit not performing signal processing for emphasizing an image change. If the change is determined to be large, the constant K is set to be a predetermined value within the range of "$0 < K < 1$".

An operation performed when a motion image region is determined for a large image data change will be described below.

Assume that a response speed of one pixel of the liquid crystal display panel 128 is, e.g., 50 [ms] (≈3 frames). In this case, the constant K of equation (5) is set as "$K = \frac{1}{2}$". Therefore, the multiplier 124 converts the signal $w_{n-1}$ delayed by the delay circuit 122 into "$w_{n-1}/2$", and the subtracter 123 performs a subtraction of:

$$w_n - w_{n-1}/2$$

The multiplier 125 doubles the signal and supplies a signal of "$2w_n - w_{n-1}$" to the limiter 126. The limiter 126 performs an operation of, e.g.,:

$$x_n = (2w_n - w_{n-1})/3 + \tfrac{1}{3}$$

and outputs a signal $x_n$. The signal $x_n$ output from the limiter 126 is supplied to the segment driver 127 and displayed on the display panel 128.

According to the above embodiment described above in detail, when an image change is large, data subjected to signal processing for emphasizing the image change is used to drive the liquid crystal display panel. Therefore, the influence which produces an afterimage can be removed without producing noise, and the low response speed of the liquid crystal display panel can be compensated for.

3rd Embodiment

The third embodiment of the present invention will be described below.

Figure 5:
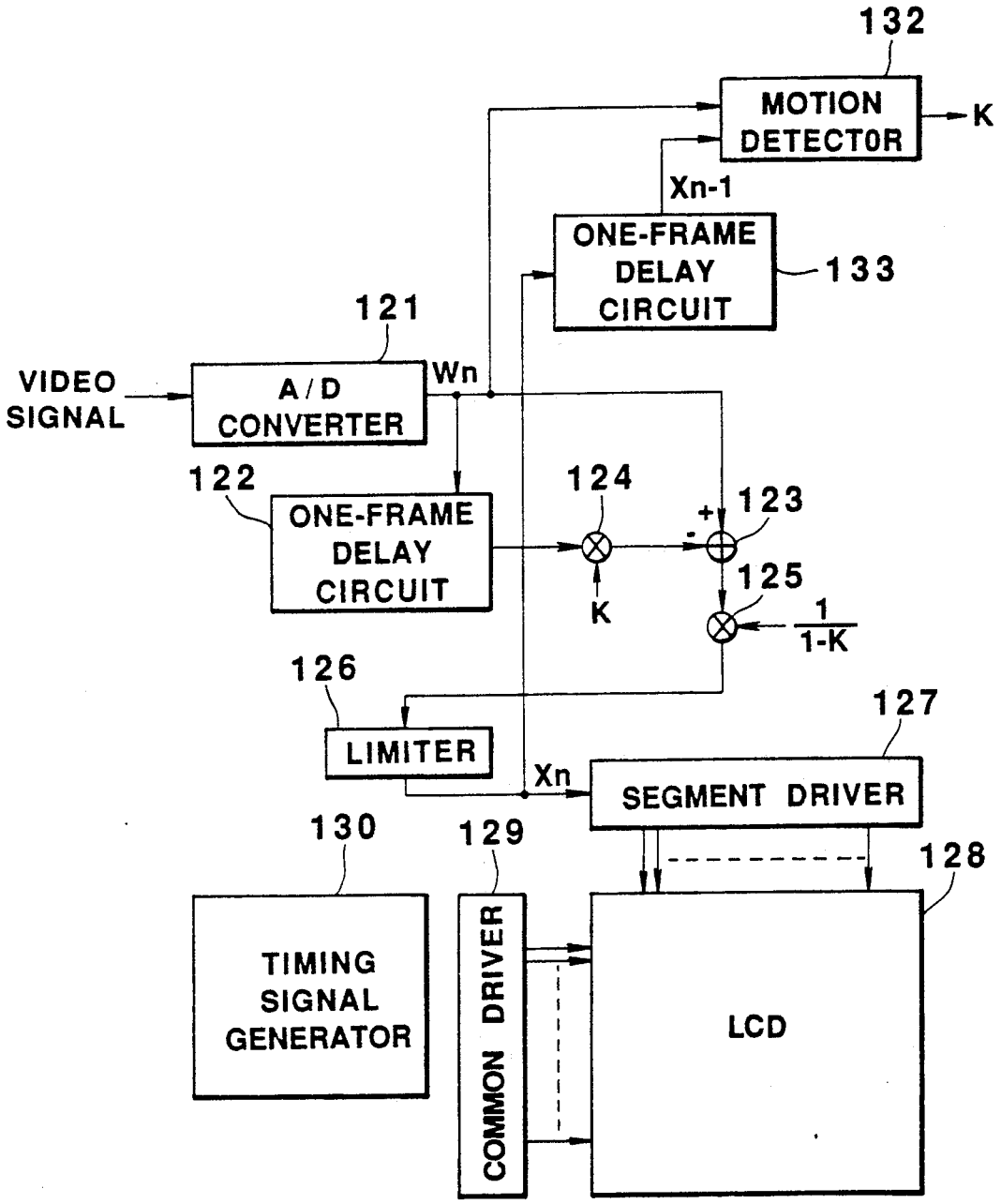
FIG. 5 is a block diagram showing a circuit arrangement of a liquid crystal driving apparatus according to the third embodiment of the present invention.

In the second embodiment shown in FIG. 4, whether a motion is present in an image is detected in accordance with the signal $w_n$ output from the A/D converter 121 and the signal $w_{n-1}$ delayed by one frame by the one-frame delay circuit 122. This image motion detection, however, can also be performed by using the signal $w_n$ and the signal $x_n$ as an output from the limiter 126. FIG. 5 shows still another arrangement which realizes this operation. Since the basic arrangement of FIG. 5 is similar to that of the embodiment shown in FIG. 4, the same reference numerals as in FIG. 4 denote the same parts in FIG. 5 and a detailed description thereof will be omitted.

Referring to FIG. 5, a digital signal $w_n$ output from an A/D converter 121 is supplied to a motion detector 132. The detector 132 also receives a signal $x_{n-1}$ obtained by delaying a signal $x_n$, output from a limiter 126, by one frame via a one-frame delay circuit 33. The detector 132 checks in accordance with the difference between the two signals $w_n$ and $x_{n-1}$ having a time difference of one frame, depending on whether the pixel of interest is present in a motion image region or still image region, and outputs a constant K to multipliers 124 and 125 in accordance with the check result.

An operation of the motion detector 132 is similar to that of the motion detector 131 shown in FIG. 4. While, however, the detector 131 has a flat frequency characteristic and emphasizes an image change regardless of frequency, the detector 132 has a frequency characteristic similar to that of a high-pass filter and therefore its degree of emphasis is increased as the frequency increases. As described above, a transfer function H(Z) of the liquid crystal display panel is represented by equation (3). By substituting equation (6):

$$Z^{-1}=e^{-jwT} \quad (6)$$

into equation (3) to check the frequency characteristic, the following equation (7) is obtained:

$$H(Z)=\sqrt{1-2K\cos(-wT)+K^2/(1-K)} \quad (7)$$

Figure 6:
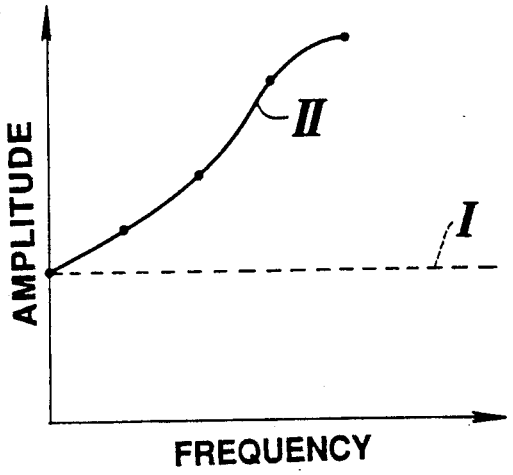
FIG. 6 is a graph showing an example of frequency characteristics with respect to a motion detector shown in FIG. 5.

FIG. 6 shows a frequency characteristic I obtained by the motion detector 131 as shown in FIG. 4 and a frequency characteristic II obtained by the motion detector 132 as shown in FIG. 5. The frequency characteristics I and II shown in FIG. 6 indicate that the detector 132 can detect a motion (i.e., an image change) better than the detector 131.

Figure 7:
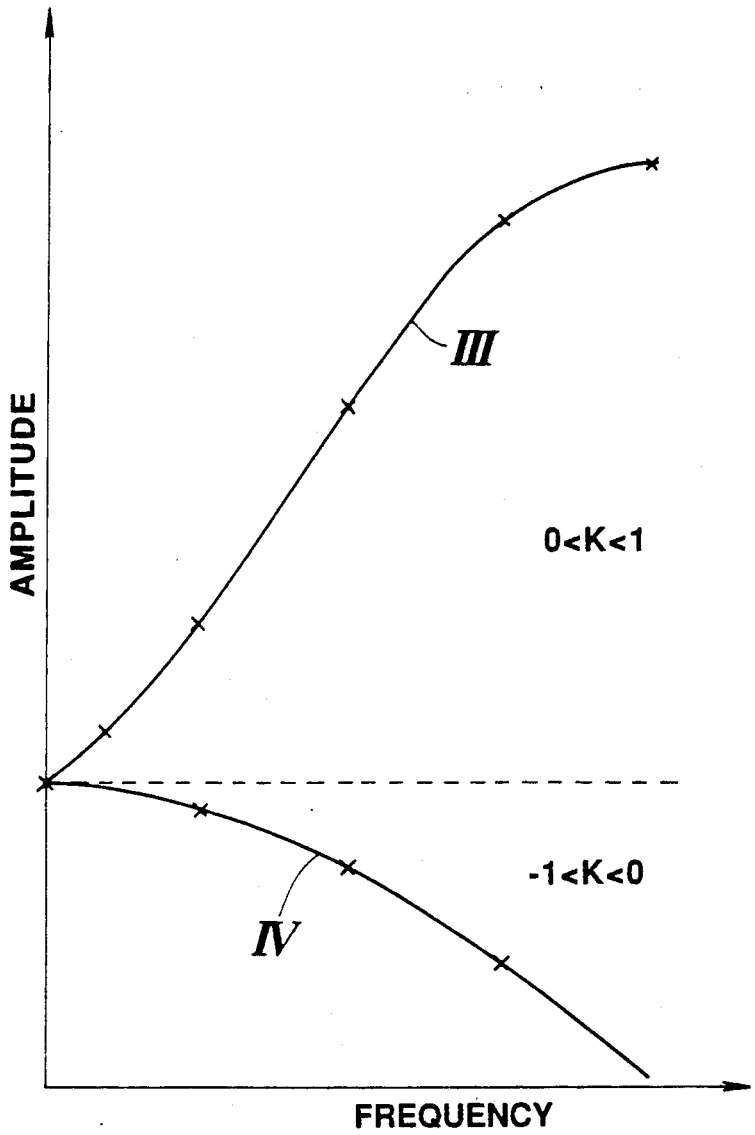
FIG. 7 is a graph showing another example of frequency characteristics with respect to the motion detector shown in FIG. 5.

In the third embodiment shown in FIG. 5, the motion detector 132 has the frequency characteristic II shown in FIG. 6. The detector 132, however, may have frequency characteristics III and IV shown in FIG. 7. That is, an operation program is set such that when the detector 132 determines that a pixel of interest is present in a motion image region, it outputs a constant K predetermined within the range of "$0<K<1$" (frequency characteristic III), and when it determines that a pixel of interest is present in a still image region, it outputs a constant K predetermined within the range of "$-1<K<0$" (frequency characteristic IV). FIG. 7 shows a relationship between the frequency and the amplitude of a signal $x_n$ processed by the constant K output from the motion detector 132 and supplied to the segment driver 127.

As described above, when the motion detector 132 determines that an image change is large, processing is performed by using the constant K output within the range of "$0<K<1$", and the amplitude of the signal xn is increased as its frequency increases. When the detector 132 determines that an image change is small, processing is performed by using the constant K output within the range of "$-1<K<0$", and the amplitude of the signal $x_n$ is decreased as its frequency increases. This is because the frequency characteristic represented by equation (7) has a high-pass-filter-like characteristic when the value of K falls within the range of "$0<K<1$" and becomes a low-pass-filter-like characteristic when it falls within the range of "$-1<K<0$".

to prevent generation of an afterimage when ,, image change is large, while generation of noise is prevented when an image change is small, thereby obtaining a clear image.

4th Embodiment

The fourth embodiment of the present invention will be described below.

The fourth embodiment exemplifies another arrangement having a function similar to the embodiment shown in FIG. 5. That is, an inverse function of equation (1) is given as follows:

$$x_n=(Y_{n+1}-Ky_{n-1})/1-K) \quad (8)$$

By substituting image input data $y_n$ of equation (8) with $w_n$, the following equation (9) is obtained:

$$x_n=(w_n-Ky_{n-1})/(1-K) \quad (9)$$

By inserting a circuit for realizing equation (9) between the A/D converter 121 and the segment driver 127 shown in FIG. 5, the same effects as in the embodiment shown in FIG. 5 can be obtained.

The fourth embodiment will be described in more detail below with reference to FIG. 8.

Figure 8:
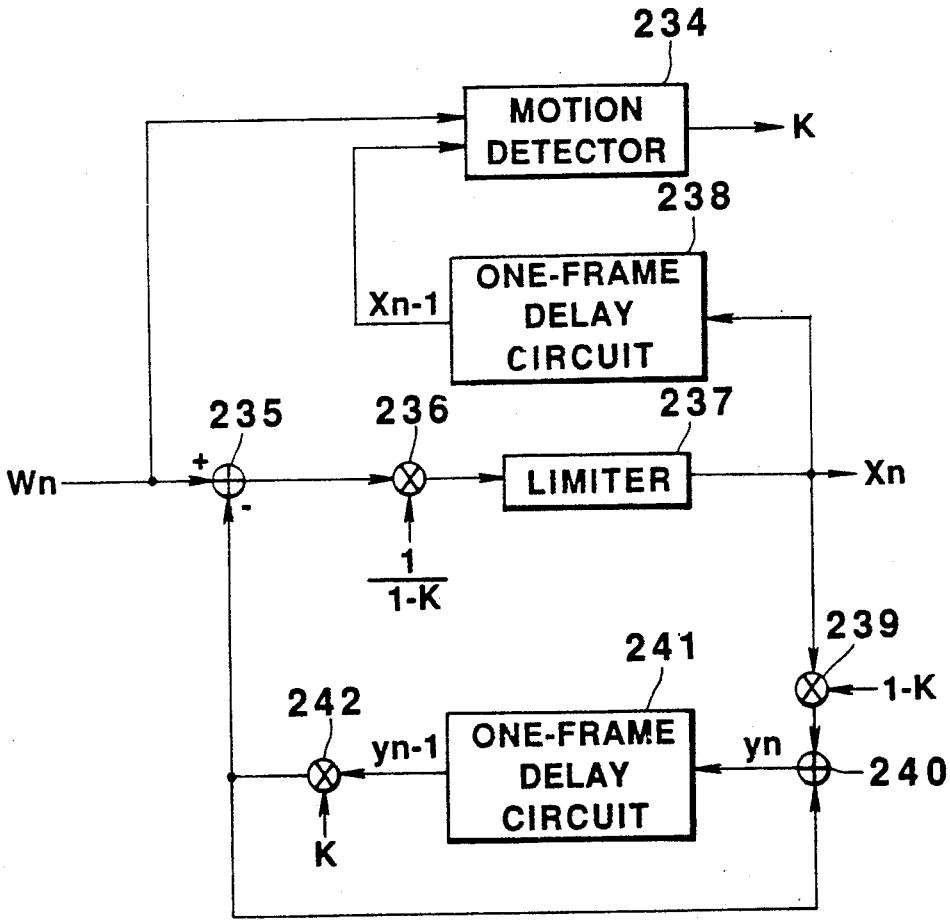
FIG. 8 is a block diagram showing a circuit arrangement of a liquid crystal driving apparatus according to the fourth embodiment of the present invention.

Referring to FIG. 8, a digital signal $w_n$ supplied from an A/D converter (not shown) in a preceding stage is sent to a motion detector 234 and the (+) input terminal of a subtracter 235. A subtraction result from the subtracter 235 is supplied to a multiplier 236. The multiplier 236 multiplies the signal supplied from the subtracter 235 by $1/(1-K)$ and outputs the signal to a limiter 237. If the supplied signal exceeds the amplitude of an output signal wn from the A/D converter, the limiter 237 limits the signal by an arithmetic operation. An output from the limiter 237 is supplied to a segment driver (not shown), a one-frame delay circuit 238, and a multiplier 239. The multiplier 239 multiplies the input signal $x_n$ by $(1-K)$ and outputs a multiplication result to an adder 240, which adds a signal from a multiplier 242 (to be described later) to the signal from the multiplier 239, and sends a signal yn as an addition result to a one-frame delay circuit 241. A signal $y_{n-1}$, delayed by one frame by the delay circuit 241, is multiplied by K by the multiplier 242 and output to the adder 240 and the (−) input terminal of the subtracter 235. The delay circuit 238 delays the signal xn by one frame and outputs a signal $x_{n-1}$ to the motion detector 234. The detector 234 checks, in accordance with the difference between the two signals $w_n$ and $x_{n-1}$ having a time difference of one frame, whether a pixel of interest is present in a motion image region or still image region and outputs a constant K to the multipliers 236, 239, and 242 in accordance with a check result.

An operation of this circuit is similar to that of the circuit shown in FIG. 5, i.e., the motion detector 234 has a high-pass-filter-like frequency characteristic. That is, as a frequency is increased, the degree of emphasis of the detector 234 is also increased. Therefore, an image change can be reliably detected. According to the fourth embodiment described above in detail, a still image region in which an image moves less and a motion image region in which an image moves more are discriminated from each other, and signal processing for emphasizing an image change in a time direction is performed for only the motion image region. Therefore, the response speed of only the necessary image region can be increased, and generation of afterimages and noise can be prevented.

5th Embodiment

The fifth embodiment of the present invention will be described below.

In the fifth embodiment, when a change in image signal is large, signal processing for emphasizing the change in correspondence with the direction of the change is performed. Therefore, an image signal change is always emphasized to a proper degree, and the response speed of only a necessary image region can be increased by a necessary amount.

A liquid crystal driving apparatus according to the fifth embodiment will be described below with reference to FIG. 9.

Figure 9:
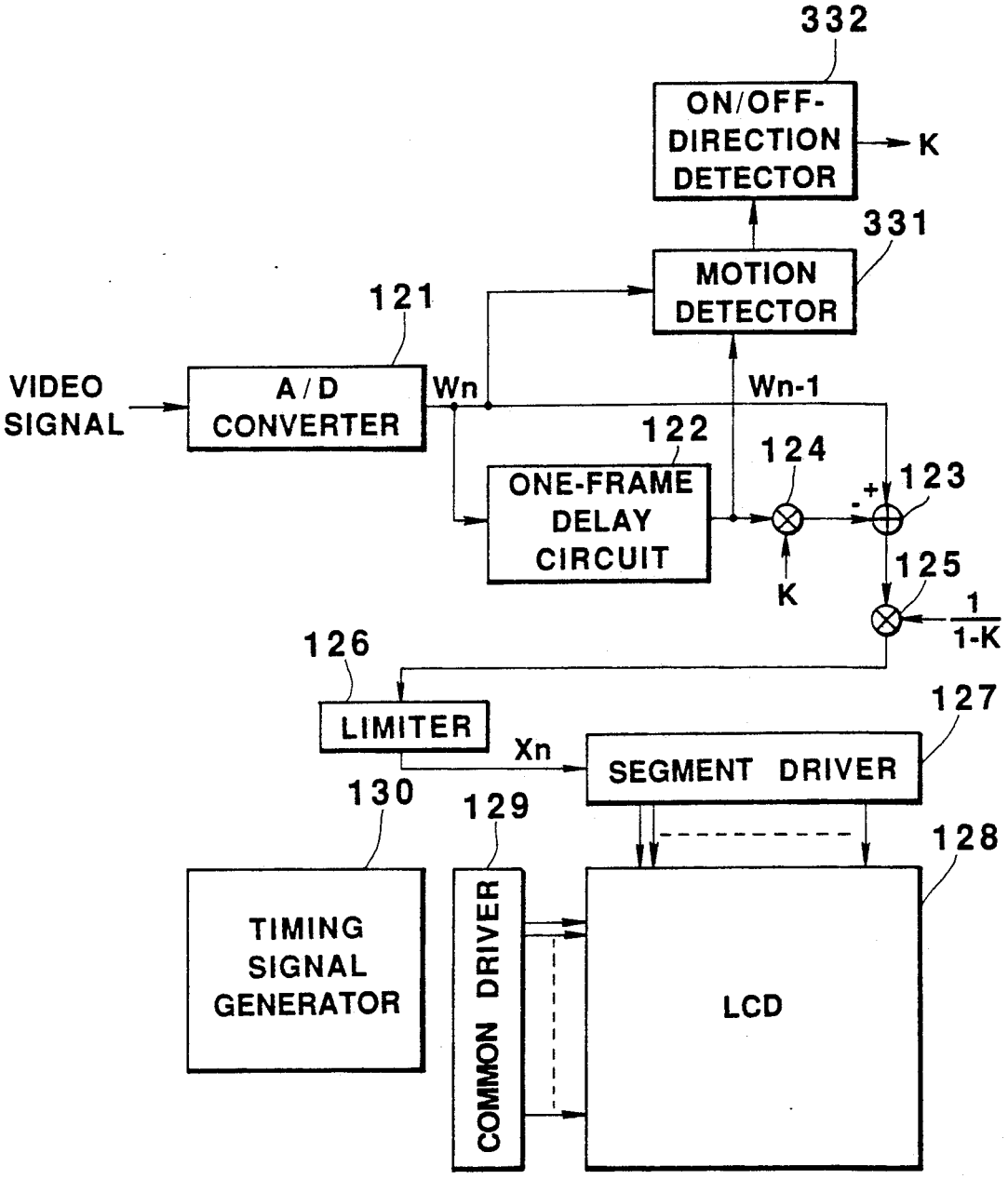
FIG. 9 is a block diagram showing a circuit arrangement of a liquid crystal driving apparatus according to the fifth embodiment of the present invention.

FIG. 9 shows a circuit arrangement of this embodiment. In FIG. 9, since the basic arrangement is similar to that of the embodiment shown in FIG. 4, the same reference numerals as in FIG. 4 will be used to denote the same parts and a detailed description thereof will be omitted.

Referring to FIG. 9, a digital signal output from an A/D converter 121 and a signal $w_{n-1}$ output from a one-frame delay circuit 122 are also supplied from a motion detector 331. The detector 331 performs subtraction for the two signals $w_n$ and $w_{n-1}$ having a time difference of one frame, and thereby checks whether an image change (motion) of a pixel of interest is large. A check result from the detector 331 is supplied to an ON/OFF-direction detector 332. The detector 332 checks, in accordance with the check result from the detector 331, i.e., the sign of the subtraction result of the signals $w_n$ and $w_{n-1}$, whether the image change direction is ON (dark→bright) or OFF (bright→dark), and outputs a constant K suitable for a transfer function of the liquid crystal display panel 128 to multipliers 124 and 125.

The motion detector 331 performs a subtraction of, e.g.,:

$$w_n - w_{n-1}$$

by using an m-bit digital signal wn output from the A/D converter 121 and an m-bit signal $w_{n-1}$ output from the one-frame delay circuit 122. If the difference exceeds a predetermined number of bits, the detector 331 determines that the image change is large. The detector 331 supplies information representing whether the sign indicating the subtraction result is positive or negative, and the determination result, to the ON/OFF-direction detector 332. When the detector 332 receives the determination result representing that the change is large from the detector 331, it checks whether the difference between the signals $w_n$ and $w_{n-1}$ is positive or negative. If the difference is positive, the detector 332 determines that the change direction is ON (dark→bright) and supplies the constant K optimal for the transfer function of the display panel 128 to the multipliers 124 and 125.

If the difference between the signals $w_n$ and $w_{n-1}$ is negative, the detector 332 determines that the change direction is OFF (bright→dark) and supplies the constant K, optimal for the transfer function of the display panel 128 in this state, to the multipliers 124 and 125.

In this manner, by variably setting the constant K for the transfer function of the liquid crystal display panel 128 in accordance with the direction of a change in image signal, an optimal degree of emphasis of the image signal change is set in the one-frame delay circuit 122, a subtracter 123, the multipliers 124 and 125, and a limiter 126.

According to the fifth embodiment described in detail above, when an image signal change is large, signal processing for emphasizing the change in correspondence with the direction of change is performed. Therefore, the image signal change is always emphasized to the proper degree, and the response speed of only a necessary region is increased, thereby preventing generation of an afterimage and noise.

6th Embodiment

The sixth embodiment of the present invention will be described below.

The sixth embodiment shows another arrangement having a function similar to the embodiment shown in FIG. 4. That is, the liquid crystal driving apparatus shown in FIG. 4 has an arrangement based on the equation of inverse transformation of the liquid crystal response represented by equation (5), i.e., based on the following equation:

$$x_n = (w_n - Kw_{n-1})/(1-K)$$

Equation (5) can also be represented as follows:

$$x_n = (w_n - K_{n-1})/(1-K) + w_n \quad (10)$$

In this embodiment, a circuit is arranged by using equation (10). The sixth embodiment will be described in detail below with reference to FIG. 10.

Figure 10:
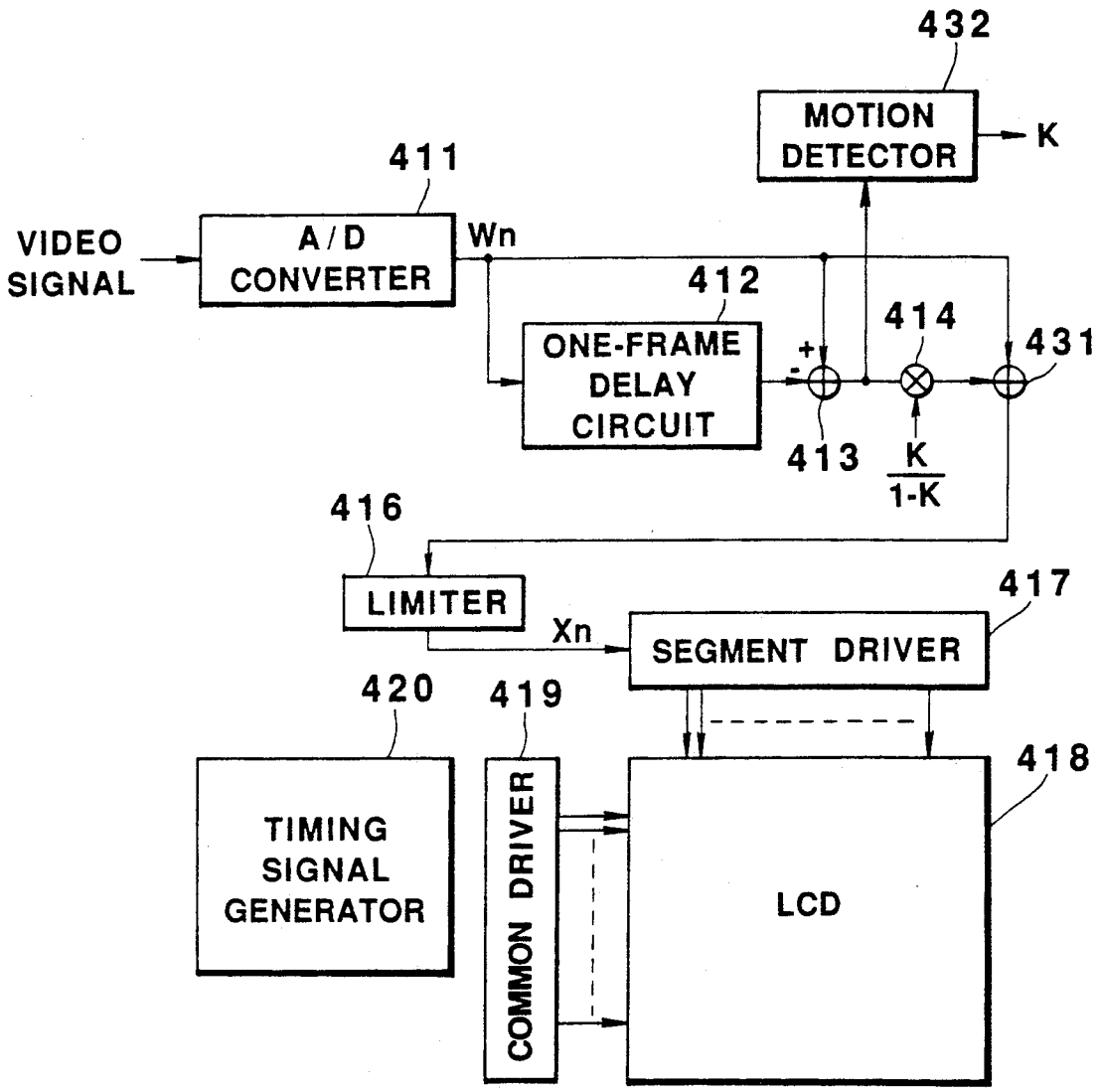
FIG. 10 is a block diagram showing a circuit arrangement of a liquid crystal driving apparatus according to the sixth embodiment of the present invention.

As shown in FIG. 10, an analog video input signal is converted into a digital signal wn by an A/D converter 411 and supplied to a one-frame delay circuit 412, the (+) input terminal of a subtracter 413, and an adder 431. A signal wn-1 delayed by one frame, e.g., 1/60 [s] or 1/30 [s] by the delay circuit 412 is supplied to the (−) input terminal of the subtracter 413. The subtracter 413 performs a subtraction of $[w_n - Kw_{n-1}]$ by using the signal wn from the A/D converter 411 and the signal $Kw_{n-1}$ from the delay circuit 412, and outputs the subtraction result to a multiplier 414 and a motion detector 432. In accordance with whether the subtraction result supplied from the subtracter 413, i.e., the difference between the two signals $w_n$ and $w_{n-1}$ having a time difference of one frame, is larger than a predetermined value, the detector 432 checks whether a pixel of interest is present in a motion image region or still image region. If the detector 432 determines a still image region in accordance with the signal from the subtracter 413, it sets a constant K to be "0", and if it determines a motion image region, it outputs a predetermined value within the range of "$0<K<1$" as the constant K. A value "$K/(1-K)$" based on the constant K output from the detector 432 is supplied as a multiplier value to the multiplier 414.

The multiplier 414 multiplies the signal supplied from the subtracter 413 by "$K/(1-K)$" and outputs the signal to the adder 431. The adder 431 adds the digital signal $w_n$ from the A/D converter 411 to the signal from the multiplier 414 and outputs the addition result to a limiter 416. If the signal supplied from the adder 431 exceeds the amplitude of the output signal $w_n$ from the A/D converter 411, the limiter 416 limits the signal by an arithmetic operation. An output from the limiter 416 is supplied as a signal $x_n$ to a segment driver 417. The segment driver 417 and a common driver 419 drive a liquid crystal display panel 418. Reference numeral 420 denotes a timing signal generator for supplying operation timing signals to the above circuits.

With the above circuit arrangement shown in FIG. 10, the response speed of the liquid crystal can be compensated for with only one multiplier, as in the circuit shown in FIG. 4. Therefore, since the circuit arrangement can be significantly simplified, the cost can be reduced and the circuit can be made compact.

7th Embodiment

The seventh embodiment of the present invention will be described below.

In the seventh embodiment, an optimal constant K is obtained when the liquid crystal display panel 418 performs a color display in the embodiment shown in FIG. 10. When the liquid crystal display panel 418 normally performs a color display, a cell gap is adjusted by changing the thickness of each of R, G, and B color filters (not shown) provided for each pixel, and the intensity of the light component of the wavelength transmitted through each filter is controlled so that it is the same for each wavelength of R, G, and B. Therefore, since the response characteristic of a liquid crystal depends on the cell gap, the response characteristics of R, G, and B pixels do not always coincide with each other. For this reason, it is not preferred to perform processing by using the same constant for R, G, and B color signals. In the seventh embodiment, therefore, when the liquid crystal display panel 418 performs a color display, a constant generator 433 is provided at the output side of the motion detector 432 of the embodiment shown in FIG. 10 and the generator 433 generates different constants K for the R, G, and B color signals, as shown in FIG. 11.

Figure 11:
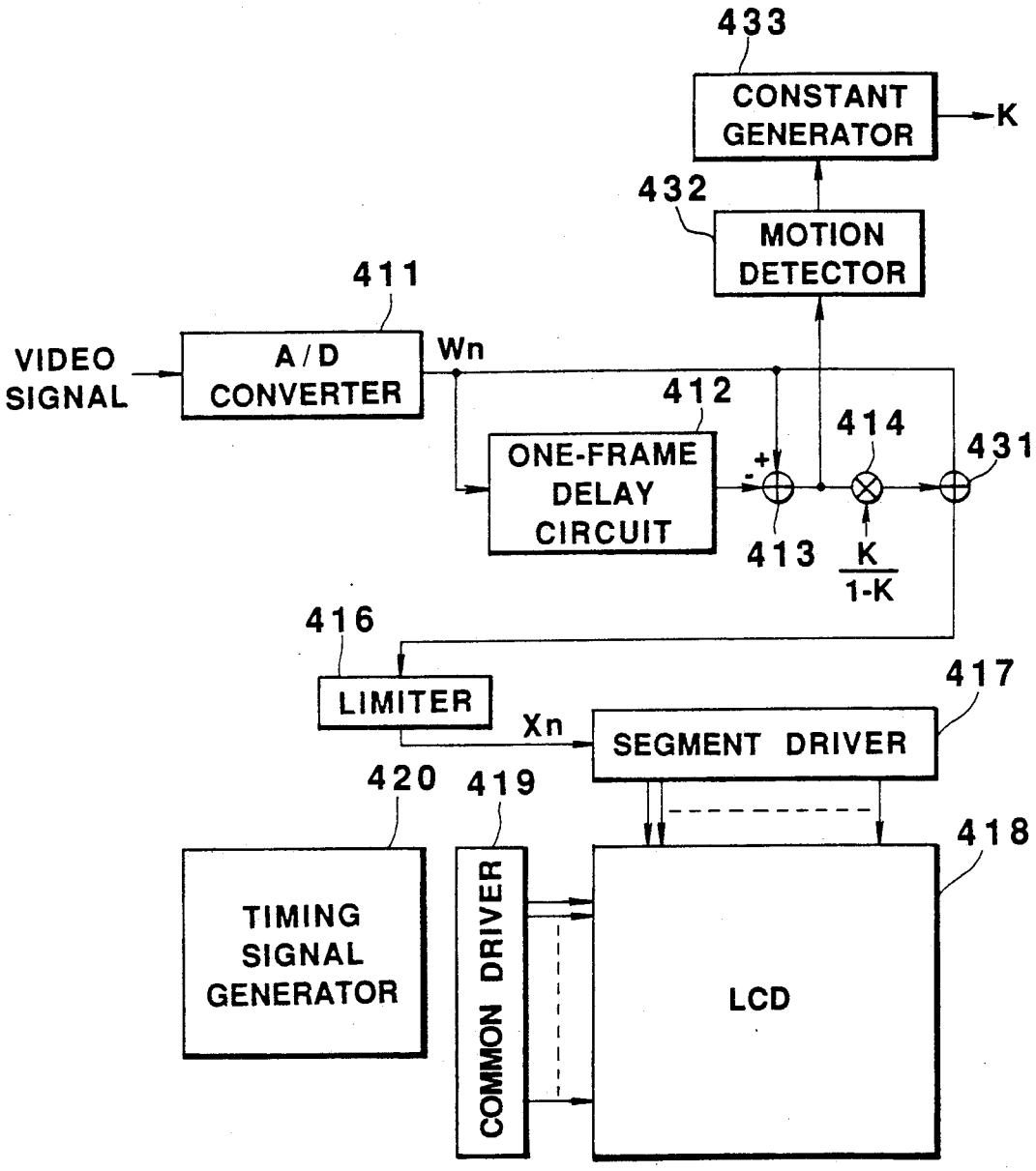
FIG. 11 is a block diagram showing a circuit arrangement of a liquid crystal driving apparatus according to the seventh embodiment of the present invention.

Referring to FIG. 11, the motion detector 432 checks whether a pixel of interest is present in a motion image region or still image region and outputs the check result to the constant generator 43 in accordance with whether a subtraction result supplied from the subtractor 413 is larger than a predetermined value. The generator 433 generates a constant K on the basis of the determination signal representing whether the region is a motion or still image region. If the pixel is in a still image region, the generator 433 sets "0" as the constant K. If the pixel is in a motion image region, the generator 433 sets an optimal value within the range of "$0<K<1$" as the constant K in correspondence with each of the R, G, and B color signals. The optimal constant K output from the generator 433 is obtained by a transfer function of a cell gap of each of R, G, and B of the liquid crystal panel 418 and is independently set for each of R, G, and B color signals. A value "$K/(1-K)$", based on the constant K output from the generator 433, is supplied as a multiplier value to a multiplier 414.

As described above, when preprocessing for emphasizing a change in image data in a time direction is to be performed, the degree of emphasis is changed for each of R, G, and B color signals in accordance with the transfer function of each of the R, G, and B color signals. Therefore, the response speed can be properly increased for a color display image.

What is claimed is:

1. A liquid crystal display apparatus, comprising:

a liquid crystal display panel having a plurality of common electrodes and a plurality of segment electrodes crossing said common electrodes;

subtracting means for, for image data constituting one image in units of frames, subtracting a K multiple of image data of the $(n-1)$th frame from image data of the nth frame, where K is a constant and n is a positive integer;

multiplying means for multiplying data output from said subtracting means by $(1/(1l-K))$ segment electrode driving means for driving the segment electrodes of said liquid crystal display panel by using data output from said multiplying means; and common electrode driving means for driving the common electrodes.

2. An apparatus according to claim 1, wherein said segment electrode driving means includes limiting means for limiting the output signal from said multiplying means within a predetermined signal range.

3. An apparatus according to claim 1, further comprising motion detecting means for detecting the amount of change of the image data in accordance with a difference between the image data of the nth frame and the image data of the $(n-1)$th frame, and setting the constant K within a range in which the amount of change of the image data exceeds a predetermined value.

4. An apparatus according to claim 3, further comprising direction detecting means for detecting the direction of a change in a image data in accordance with a detection result from said motion detecting means, and setting the constant K in accordance with the detected change direction.

5. A liquid crystal display apparatus, comprising:

a liquid crystal display panel having a plurality of common electrodes and a plurality of segment electrodes crossing said common electrodes;

A/D converting means for converting an analog image signal into a digital signal;

one-frame delaying means for delaying the digital signal output from said A/D converting means by one frame;

motion detecting means for checking, in accordance with the difference between the output signal from said A/D converting means and an output signal from said one-frame delaying means, whether the output signal from said A/D converting means is present in a motion image region or a still image region, and outputting a constant K in accordance with the check result;

first multiplying means for multiplying the output signal from said one-frame delaying means by the constant K and outputting the multiplied signal;

subtracting means for subtracting the output signal from said first multiplying means from the output signal from said A/D converting means;

second multiplying means for multiplying an output signal from said subtracting means by a value $(1/(1-K))$;

limiter means for limiting an output signal from said second multiplying means within a predetermined signal range;

segment electrode driving means for driving the segment electrodes of said liquid crystal display by using data output from said limiter means; and common electrode driving means for driving the common electrodes.

6. A liquid crystal display apparatus, comprising:

a liquid crystal display panel having a plurality of common electrodes and a plurality of segment electrodes crossing said common electrodes;

A/D converting means for converting an analog image signal into a digital signal;

first one-frame delaying means for delaying the digital signal output from said A/D converting means by one frame;

first multiplying means for multiplying an output signal from said one-frame delaying means by a constant K and outputting the multiplied signal;

subtracting means for subtracting the output signal from said first multiplying means from the output signal from said A/D converting means;

second multiplying means for multiplying an output signal from said subtracting means by a value $(1/(1-K))$ and outputting the multiplied signal;

limiter means for limiting the output signal from said second multiplying means within a predetermined signal range;

second one-frame delaying means for delaying an output signal from said limiter means by one frame;

motion detecting means for checking, in accordance with the difference between the output signal from said A/D converting means and an output signal from said second one-frame delaying means, whether the output signal from said A/D converting means is present in a motion region or a still image region, and outputting the constant K in accordance with the check result;

segment electrode driving means for driving the segment electrodes of said liquid crystal display panel in accordance with an output signal from said limiter means; and common electrode driving means for driving the common electrodes.

7. An apparatus according to claim 6, wherein said motion detecting means sets the constant K within a range of "$0<K<1$" when said motion detecting means determines that the output signal from said A/D converting means is present in a motion image region, and sets the constant K within a range of "$-1<K<0$" when said motion detecting means determines that the output signal from said A/D converting means is present in a still image region.

8. A liquid crystal display apparatus, comprising:

a liquid crystal display panel having a plurality of common electrodes and a plurality of segment electrodes crossing said common electrodes;

A/D converting means for converting an analog image signal into a digital signal;

subtracting means, having + and − terminals, for receiving an output signal from said A/D converting means at the + terminal thereof;

first multiplying means for multiplying an output signal from said subtracting means by a value $(1/(1-K))$ and outputting the multiplied signal;

limiter means for limiting the output signal from said first multiplying means within a predetermined signal range;

first one-frame delaying means for delaying an output signal from said limiter means by one frame;

motion detecting means for checking, in accordance with the difference between the output signal from said A/D converting means and an output signal from said first one-frame delaying means, whether the output signal from said A/D converting means is present in a motion image region or a still image region, and outputting a constant K in accordance with the check result;

second multiplying means for multiplying the output signal from said limiter means by a value $(1-K)$ and outputting the multiplied signal;

adding means, having two input terminals, for receiving the output signal from said second multiplying means at one input terminal thereof;

second one-frame delaying means for delaying an output signal from said adding mans by one frame;

third multiplying means for multiplying an output signal from said second one-frame delaying means by the constant K and outputting the multiplication result to the—terminal of said subtracting means and the other input terminal of said adding means;

segment electrode driving means for driving the segment electrodes of said liquid crystal display panel in accordance with an output signal from said limiter means; and common electrode driving means for driving the common electrodes.

9. A liquid crystal display apparatus, comprising:

a liquid crystal display panel having a plurality of common electrodes and a plurality of segment electrodes crossing said common electrodes;

subtracting means for, for image data constituting one image in units of frames, subtracting image data of the $(n-1)$th frame from image data of the nth frame;

multiplying means for multiplying data output from said subtracting means by $(K/(1-K))$;

adding means for adding data output from said multiplying means to the data of the nth frame;

segment electrode driving means for driving the segment electrodes of said liquid crystal display panel using data output from said adding means; and common electrode driving means for driving the common electrodes.

10. An apparatus according to claim 9, further comprising constant generating means for comparing the output data from said subtracting means with a predetermined reference value, determining a still image region when the output data is smaller than the predetermined reference value, and determining a motion image region when the output data is larger than the predetermined reference value.

11. An apparatus according to claim 10, further comprising limiter means, located between said adding means and said segment electrode driving means, for limiting the output signal from said adding means within a predetermined signal range.

12. An apparatus according to claim 9, further comprising:

motion detecting means for comparing the output data from said subtracting means with a predetermined reference value, and determining a still image region when the output data is smaller than the predetermined reference value and determining a motion image region when the output data is larger than the predetermined reference value; and constant generating means for generating a constant K for each of R, G, and B color signals corresponding to the data of the nth frame on the basis of a detection signal from said motion detecting means.

13. An apparatus according to claim 12, further comprising limiter means, located between said adding means and said segment electrode driving means, for limiting the output signal from said adding means within a predetermined signal range.

14. A liquid crystal display apparatus, comprising:

a liquid crystal display panel having a plurality of common electrodes and a plurality of segment electrodes crossing said common electrodes;

supply means for supplying an image signal;

one-frame delaying means for delaying the image signal supplied from said supplying means by one frame;

motion detecting means for checking, in accordance with the difference between the image signal supplied from said supply means and an output signal from said one-frame delaying means, whether the image signal is present in a motion image region or a still image region, and outputting a constant K in accordance with the check result;

first multiplying means for multiplying the output signal from said one-frame delaying means by the constant K ad outputting the multiplied signal;

subtracting means for subtracting the output signal from said first multiplying means from the image signal from said supply means;

second multiplying means for multiplying an output signal from said subtracting means by a value $(1/(1-K))$ and outputting the multiplying signal;

limiter means for limiting the output signal from said second multiplying means within a predetermined signal range;

segment electrode driving means for driving the segment electrodes of said liquid crystal display panel using data output from said limiter means; and common electrode driving means for driving the common electrodes.

15. A liquid crystal display apparatus, comprising:

a liquid crystal display panel having a plurality of common electrodes and a plurality of segment electrodes crossing said common electrodes;

supply means for supplying an image signal;

first one-frame delaying means for delaying the image signal supplied from said supplying means by one frame;

first multiplying means for multiplying the output signal from said first one-frame delaying means by the constant K and outputting the multiplied signal;

subtracting means for subtracting the output signal from said first multiplying means from the image signal from said supply means;

second multiplying means for multiplying an output signal from said subtracting means by a value $(1/(1-K))$ and outputting the multiplied signal;

limiter means for limiting the output signal from said second multiplying means within a predetermined signal range;

second one-frame delaying means for delaying an output signal from said limiter means by one frame;

motion detecting means for checking, in accordance with the difference between the image signal supplied from said supply means and an output signal from said second one-frame delaying means, whether the image signal is present in a motion image region or a still image region, and outputting a constant K in accordance with the check result;

segment electrode driving means for driving the segment electrodes of said liquid crystal display panel in accordance with an output signal from said limiter means; and common electrode driving means for driving the common electrodes.

* * * * *